US011221195B2

(12) United States Patent
Weinbeer et al.

(10) Patent No.: US 11,221,195 B2
(45) Date of Patent: Jan. 11, 2022

(54) METHOD AND DEVICE FOR PROTECTING A VEHICLE AGAINST A THREAT

(71) Applicant: Rheinmetall Waffe Munition GmbH, Unterlüß (DE)

(72) Inventors: Jan Weinbeer, Bad Reichenhall (DE); Christian Lichtmannegger, Bischofswiesen (DE)

(73) Assignee: RHEINMETALL WAFFE MUNITION GMBH, Unterlüß (DE)

( * ) Notice: Subject to any disclaimer, the term of this patent is extended or adjusted under 35 U.S.C. 154(b) by 0 days.

(21) Appl. No.: 17/043,075

(22) PCT Filed: Feb. 13, 2019

(86) PCT No.: PCT/EP2019/053578
§ 371 (c)(1),
(2) Date: Sep. 29, 2020

(87) PCT Pub. No.: WO2019/206485
PCT Pub. Date: Oct. 31, 2019

(65) Prior Publication Data

US 2021/0018302 A1 Jan. 21, 2021

(30) Foreign Application Priority Data

Apr. 27, 2018 (DE) ..... 10 2018 110 241.0

(51) Int. Cl.
*F41H 11/02* (2006.01)

(52) U.S. Cl.
CPC ..... *F41H 11/02* (2013.01)

(58) Field of Classification Search
CPC ..... F41H 11/02
USPC ..... 89/36.16
See application file for complete search history.

(56) References Cited

U.S. PATENT DOCUMENTS

| | | | | |
|---|---|---|---|---|
| 2014/0278734 | A1 | 9/2014 | Mather et al. | |
| 2017/0285142 | A1 | 10/2017 | Parker et al. | |
| 2018/0058822 | A1 * | 3/2018 | Vaitekunas | F41G 7/224 |
| 2018/0335779 | A1 | 11/2018 | Fisher et al. | |

FOREIGN PATENT DOCUMENTS

| | | | | |
|---|---|---|---|---|
| GB | 2136097 A * | 9/1984 | | F41G 5/08 |
| WO | WO-2014021961 A2 * | 2/2014 | | G05D 1/0055 |
| WO | WO-2015/187768 A1 | 12/2015 | | |
| WO | WO-2017/106005 A1 | 6/2017 | | |

* cited by examiner

*Primary Examiner* — Samir Abdosh
(74) *Attorney, Agent, or Firm* — Harness, Dickey & Pierce, P.L.C.

(57) ABSTRACT

A method is proposed for protecting a vehicle (2) from a threat (3), in which the threat (3) is recognized as such, preferably classified and a countermeasure (11) is implemented against the threat (3). For this purpose, a new overall situation resulting therefrom, consisting at least of a new wind direction and wind speed, as well as the direction of the threat and the threat distance, is calculated for every change of course and voyage. The calculated course and journey changes are displayed, in which a countermeasure to protect the vehicle can still be successfully implemented. The calculation takes into account at least wind data, threat type and threat direction. Furthermore, at least the vehicle's own data should be taken into account.

15 Claims, 3 Drawing Sheets

METHOD AND DEVICE FOR PROTECTING A VEHICLE AGAINST A THREAT

CROSS REFERENCE TO RELATED APPLICATIONS

This application is a national phase entry of PCT/EP2019/053578, filed on 13 Feb. 2019, which claims priority to and the benefit of German Patent Application No. 10 2018 110 241.0, filed on 27 Apr. 2018, the entire contents of which are incorporated herein by references.

FIELD

The invention relates to a method and a device for the protection of an object/vehicle on water, on land and in the air (hereinafter referred to as a vehicle) against a threat, in particular an RF guided missile. The invention relates in particular to a method and a device which implement an optimal provision of a decoy target or a decoy cloud.

In practice, such objects or vehicles are threatened by missiles with search heads, so-called guided missiles (GM). These GM use IR radiation emitted by the vehicle or RF radiation reflected by the vehicle to switch on to this radiation and thus onto the vehicle in order to hit the vehicle. To defend the vehicle, decoy targets are then deployed as a protective measure or a countermeasure, which then interrupt the line of sight in the IR or RF area between the threat and the vehicle or that move away from the vehicle in order to create a more interesting target for the threat, so that this switches onto the new decoy target. During this time, the vehicle can then be moved out of the danger zone. Such decoy targets are deployed by a weapons system, such as a launcher, wherein active material generates the protective measure.

BACKGROUND

A method is known from EP 0 805 333 B1 for providing a decoy target, which is characterized in that the IR and RF active materials are activated by means of an activation and distribution device, which is arranged centrally, and are agitated or distributed. The target search head acting in one of the two wavelength ranges or simultaneously in both wavelength ranges receives radiation emitted in the IR region and retroreflected RF radiation, at which point the target search head switches itself on.

EP 2 612 101 B1 discloses a device and a method for generating an effective smokescreen. DE 103 46 001 B4 cited in this document takes into account the type of missile, the direction of the missile attack, the missile distance, and the missile speed. Furthermore, the kinematic data of the ship, such as the ship's speed, ship's own movements, the direction of travel of the ship, the ship's aspect/signature are taken into account as well as the environmental data such as wind speed and wind direction. An optimal solution for protection is determined from these.

SUMMARY

The missile defense or protection is in most cases strongly dependent on the relative wind. In a defensive situation, situations can often arise in which the calculated solution (defensive or protective measure) is unsatisfactory due to the environmental parameters.

In the case of the existing defensive or protective measures it is not sufficiently taken into account that the environmental situation changes due to the passage of time and by changes of the relative wind within a short time. In particular, these changes are clearly noticeable when course changes of the vehicle to be protected occur.

It is therefore the object of the present invention to remedy this disadvantage.

The object is achieved by the features of claim 1. Advantageous versions are mentioned in the subordinate claims.

The invention proceeds from the consideration that in particular when the course of the vehicle changes a change of the relative wind on the protective measure takes place due to the new position assumed by the vehicle equipment. A wind from the north north east may hit the vehicle from the front before the change of course and now laterally after the change. If this change is not taken into account by the system when deploying the countermeasure, the situation may arise in which an optimal application of the countermeasure is no longer possible or can no longer be guaranteed. The system, for example one or more launchers in combination with at least one computer, for example a so-called fire control computer, and actuators for orienting the launcher etc., can no longer deploy the countermeasure in time or only ineffectively.

A change of course also takes a certain amount of time. In this time the threat approaches the vehicle at high speed. Related to this, the threat search parameters change, such as the depth of the radar gate (depth range) and the (absolute) width of the radar lobe for a RF-GM.

As is known, a depth range is defined via the pulse repetition frequency and the pulse repetition interval of a radar signal emanating from a GM (threat), which the search head observes. Everything outside this range is not included by the GM in its calculation. The aim is therefore, on the one hand, to fire precisely in this range, to apply the countermeasure and, on the other hand, to achieve separation from the vehicle to bring the vehicle as far as possible out of this range at the end, i.e. so that the vehicle is as far outside this range as possible.

Both changes, the change of the threat search parameters and the change of the relative wind, can thus cause the determined or calculated solution to have changed when adopting a particular course and speed combination such that optimal application of the countermeasure, such as the formation of a decoy target or a decoy body cloud, becomes problematic.

According to the invention, the resulting situation is now calculated for each course and speed combination. The result of this is that if the vehicle adopts this combination, there is actually a firing solution. This is displayed accordingly. In this case, according to the invention this involves changing vectors and directions and the representation of a set (in the mathematical sense) of course and speed recommendations. Thus, course and speed changes result from a new combination of wind direction and strength, threat direction and distance. A targeted course change and a consequent change in the relative wind are taken into account. Thus, a significant improvement of the calculated solution is obtained or even made possible in the first place.

For each course/speed combination, the time required for the change of course (direction) and speed (velocity) is determined by means of available kinematic data of the vehicle. A solution corresponding to these new circumstances is computed or calculated on the basis of these data available for each course/speed combination and other current data, such as relative wind, the new distance of the threat, the new relative threat direction. In the computation, at least the threat direction, the threat type (spot number), the wind (direction, strength), the own course, the speed, such as the velocity, the load state of the system, as well as dead zones of the system or the launchers etc. are used. Also, other vehicle's own data or ship's own data such as size, tonnage, propulsion type etc. may be taken into account.

Once a threat is determined, i.e. the type of threat, threat direction, etc., a computer of the system starts to calculate the resulting situation on the basis of all available information for each course and speed combination. It is advantageous if the threat is also classified. The threat can be classified, for example, based on the radar signals emitted for target analysis, as a so-called fingerprint of the threat.

For the computation of the solution set (set of course/speed combinations), the position (cloud position) for the impending threat position is determined and made available. The solutions are calculated using the determined cloud position and using a library in which specifiable data such as various wind directions, wind speeds, initial contacts with the threat, etc. are stored. From this data in comparison with the determined data, course and speed combinations are calculated, then the quality of the solution is computed and displayed. In doing so, mainly only the course and speed combinations which are achieved by the system until the impact of a threat, such as a missile, are taken into account in order to prevent unnecessary delays of the solution set.

In the calculation of the solution, i.e. the separation of the countermeasure (decoy target) and the vehicle, a solution quality plays an important role in the development of the invention. The solution quality can be computed for each calculated solution on the basis of defined algorithms. The solution quality is understood here to mean the quality which gives information about the achievable separation of the decoy target and the vehicle. This quality is determined depending on the delivery point of the decoy target and the radial and lateral components of the relative wind from the point of view of the threat. The quality of the solution is therefore computed and presented for all still achievable course and speed combinations. The presentation can be carried out on a display of the system. The operator can thus react in an optimized manner to the specific impending threat situations select and can thus seek and announce appropriate course and speed recommendations.

A good solution indicates, for example, that the decoy target achieves such a depth separation that at the end of the removal process the tracking gate is pulled away from the vehicle and the lateral separation comes fully into effect. In addition, a large lateral separation is achieved. The lateral separation is >150 m and the vehicle is outside the range gate of the threat.

In a solution classified as adequate, the decoy target achieves a depth separation such that at the end of the removal process the track gate of the threat is moved away from the vehicle and the lateral separation of the decoy target from the vehicle is fully effective, but only a small lateral separation is achieved, which is >30 m and at least 30% of the perspective of the vehicle, although the vehicle is still outside the range gate of the threat.

A weak solution, on the other hand, exists when the decoy target does not achieve depth separation. The decoy target and the vehicle remain together in the track gate of the threat until just before the end. The threat flies to the common radar center point of the decoy target and the vehicle. Whether the decoy target or the vehicle is ultimately seen by the threat is a random outcome.

These different solutions can be represented in a polar representation, for example color differentiated. Also solutions that result in drift or windage of the applied cloud over the vehicle (cloud over ship) can be reproduced in color.

The visualization is carried out by a preferably colored underlay of these areas (solution set) in a polar representation. Although a color in different shades has proved adequate, it is not to be regarded as restrictive. According to the invention, the color shades represent a kind of quality of the protection or countermeasure.

A solution classified as a weak solution can be represented by light green, an adequate solution by green and a good solution by dark green. The green shadings are suitable, as these usually mark a proper operation. Of course, other colors and/or shades of color may also be taken into account or may be used.

These differences shown in color will give the operator an opportunity to read from the situational picture at a glance how the determined course and speed change affects the quality of the solution.

In order to avoid that the computed solution set does not deviate from reality, in a further development of the invention it is provided to not only use a single cloud position of the threat in the computation of the solution set, since this only indicates the current situation. By this measure it can be ensured that it is avoided that although a course and speed vector is in a solution set the system does not find a firing solution, or vice versa that the system determines a firing solution although the course and speed vector is not within the solution set. As a result, changes due to the change in the course and speed of the vehicle itself relative to the threat can now be better taken into account.

A method is proposed to protect a vehicle from a threat (Anti-Ship Missile Defense—ASMD) in which the threat is identified as such, is classified and a countermeasure against the threat is deployed. For each change of course and speed, a resulting new overall situation is calculated consisting of new wind direction and speed and threat direction and distance. Only the calculated course and speed changes for which a countermeasure for the protection of the vehicle can still be successfully applied are displayed.

A determined quality of the countermeasure can be displayed for the operator, wherein the quality gives information about the achievable separation of the countermeasure and the vehicle from the point of view of the threat. The quality is differentiated into bad, adequate, or good. This differentiation of quality can be represented in color.

A specification of the tactical computation of firing triggering and the computation and presentation of course-speed recommendations is therefore provided. Here, for example, one can also distinguish between tactical mode and planning mode. In planning mode, whether there is a solution and the quality thereof are computed for all course speed combinations (0°-359°/min. ship speed/max. ship speed). For each course-speed combination, on the other hand, the specific situation is calculated, consisting of relative wind, distance and bearing of the threat when adopting the course-speed combination, cloud position(s) of the threat and the quality of the solution. In the tactical mode, in addition, in order to reduce the computing time, the number of course-speed combinations to be calculated can be reduced, so that only tactically relevant solutions are considered and only these are displayed. During this, solutions that are more than +/−90° away from the current course can be disregarded. These are therefore not taken into account in the tactical mode.

BRIEF DESCRIPTION OF THE DRAWINGS

The invention will be explained in more detail on the basis of an exemplary embodiment with a drawing. In the figures.

DETAILED DESCRIPTION

Figure 1:
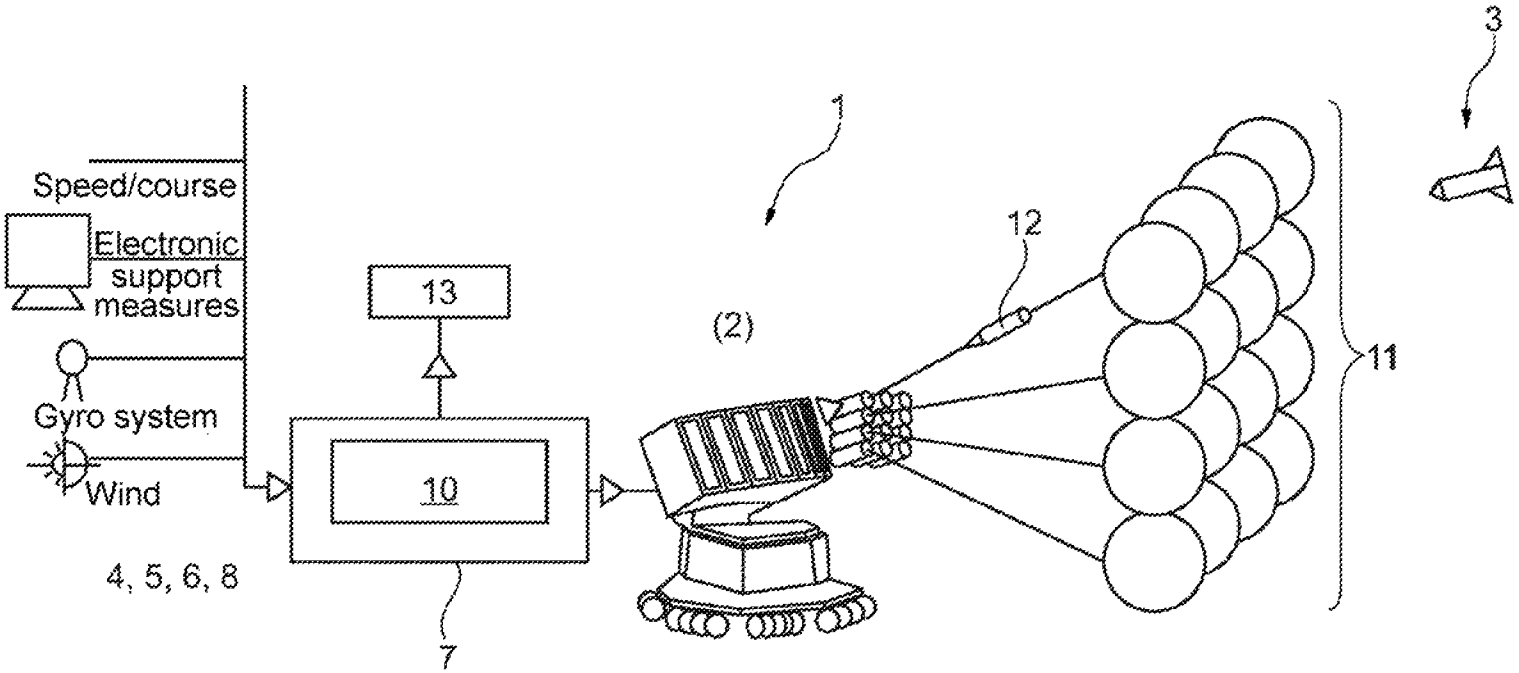
Prior art Fig. 1
FIG. 1 shows a sketch representation of a system for the protection of an object against a threat according to the prior art.

In FIG. 1 a system 1 is shown for the protection of a vehicle 2 against a threat 3 according to the prior art (DE 103 46 011B4). This document is hereby referred to in full. The system 1 shown herein is used to protect ships 2 from end-phase steered guided missiles 3 with a target data analysis system. In this case, the missile moving towards the ship 2 to be protected is detected by suitable sensors 4, 5, 6, said missile is located, and its probable flight path is computed by means of a computer (fire control computer) 7. The missile 3 itself can be classified by means of its target data analysis. In addition, the current wind speed and wind direction are continuously detected by wind sensors 8.

Also ship's own data, such as speed of travel, direction of travel (navigation system) and possibly roll and pitch movements (roll sensors or gyro sensors) are determined. All data are transmitted to the fire control computer 7 and stored in a database 10. This fire control computer 7 is functionally connected to at least one steerable launcher unit 9. The launcher unit 9 is responsible in this exemplary embodiment for the deployment of one or more countermeasures.

Depending on the detected guided missile 3 and the attack structure, a certain decoy body pattern 11 is generated. For this purpose, a suitable decoy body pattern for each guided missile is stored in the database 10 of the fire control computer 7. This pattern can then be retrieved by the fire control computer 7 to build up a corresponding decoy body pattern 11. Regarding the computation of the ballistic trajectories of the decoy munitions (decoy targets) 12 etc., reference is made to DE 103 45 001 B4, for example.

According to the present invention, however, the fire control computer 7 now computes not only an optimal ship course and an optimal ship speed for the separation of the decoy munition 12 or the decoy body pattern 11 from the vehicle to be protected 2, but computes for each course and speed possibility of the vehicle 2 which allows protection of the vehicle 2 against the threat 3. These are defined as solutions.

Figure 2:
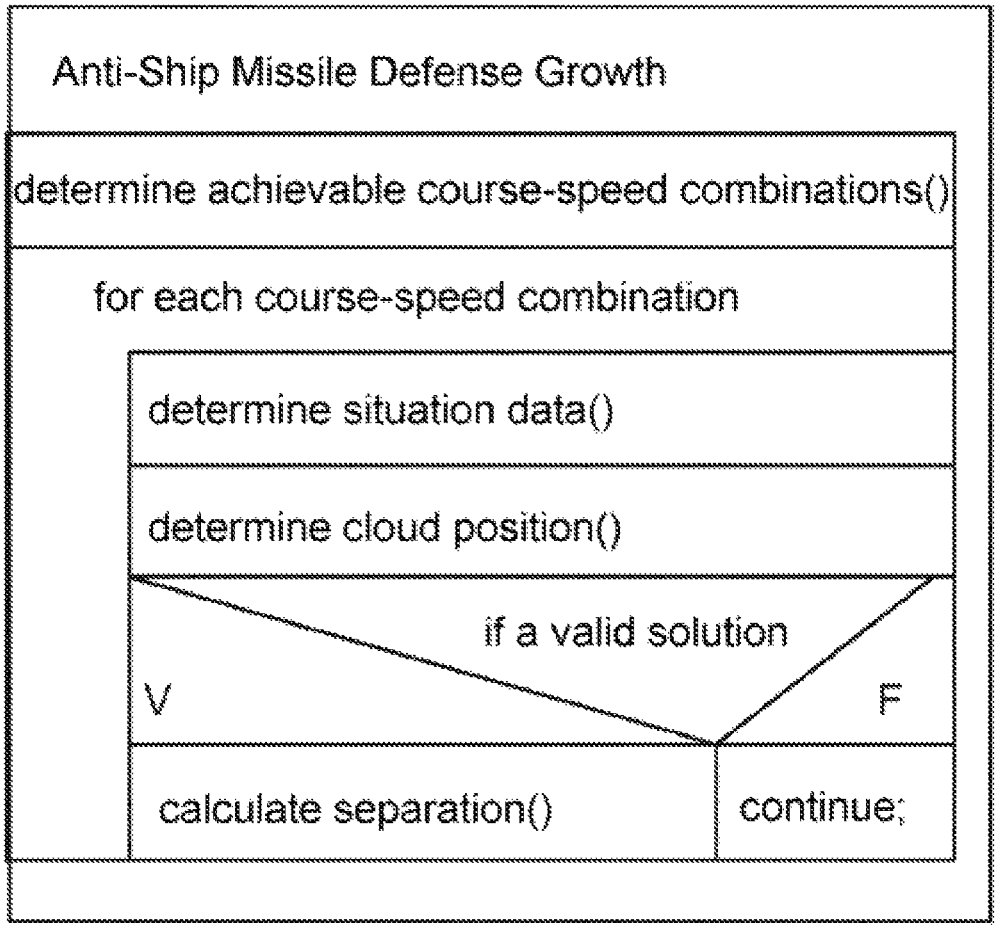
FIG. 2 shows a representation of the process of the method for protecting the object against the threat.

FIG. 2 shows the process of the method in a simple overview. In a first step of this expansion, each achievable course and speed combination is determined.

In order to be able to carry out the computation, the following data should be available, preferably all but at least some: data regarding the threat direction, the threat type (spot number), the wind, course and speed, the load state of the at least one launcher unit 9, the kinematic data, the vehicle's own data or the ship's own data, and/or action zones of the at least one launcher unit 9.

Figure 3:
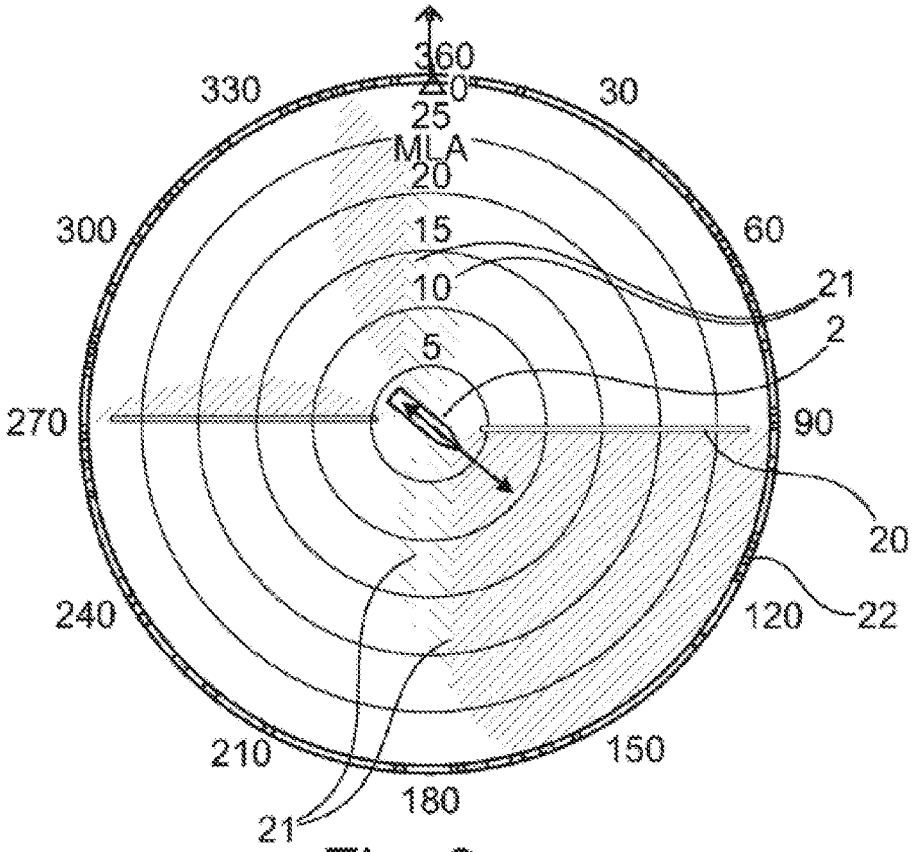
FIG. 3 shows a visualized representation in the form of a polar representation.

Once a threat 3, here an RF-GM, is detected, the fire control computer 7 starts to compute the solutions or solution sets on the basis of the available data and information for all course and speed combinations that are still achievable and to determine the quality of the solution. These solutions can then be visualized to an operator on a display 13 (FIG. 3). The computation of the quality of the solution for each course and speed combination is thus carried out at least on the basis of a predetermined wind situation and a predetermined threat 3.

Regarding the quality, three grades can be distinguished in the present case, a weak solution, an adequate solution, or a good solution.

The solutions can also be displayed for visualization in the same color but in different shades. The color green usually marks a proper operation. Therefore, the weak solution can be represented by a light green area 20, the adequate solution by a green area 21 and the good solution by a dark green area 22. Other color combinations are also conceivable. This gives the operator the opportunity to read at a glance how a respective course and speed change affects the quality of the solution. He can react in an optimized manner to the specific threat situation and can evaluate or instruct regarding appropriate course and speed recommendations.

In order to prevent unnecessary delays in the computation of the solutions, it is provided to reduce the solution sets to be calculated to a necessary minimum. Only the course and speed combinations that can be achieved up to the computed impact of the threat 3 are taken into account. On the other hand, others are eliminated.

In order to avoid that the computed solution sets could not be in line with reality, it is provided that more than only one current cloud position of the threat 3 is used for the calculation of the solution or solution set.

After a defined time, the situation picture is updated again and is again shown on the display 13.

What is claimed is:

1. A method for protecting a vehicle against a threat, with which the threat is identified as such and a countermeasure is deployed against the threat, wherein for each change of course and speed, a resulting new overall situation is calculated including at least a new wind direction and wind speed as well as a threat direction and threat distance;

wherein a quality of the countermeasure is determined and displayed, wherein the quality gives information about the achievable separation of the countermeasure and the vehicle from the point of view of the threat.

2. The method as claimed in claim 1, wherein the threat is classified.

3. The method as claimed in claim 1, wherein the calculated course and speed changes are displayed, for which a countermeasure for the protection of the vehicle can still be successfully devised.

4. The method as claimed in claim 1, wherein at least wind data, threat type and threat direction are taken into account in the calculation.

5. The method as claimed in claim 1, wherein furthermore at least the vehicle's own data are taken into account in the calculation.

6. The method as claimed in claim 1, wherein a load state, i.e. the number of countermeasures, is taken into account in the calculation.

7. The method as claimed in claim 1, wherein the quality is differentiated as a bad, adequate, or good quality.

8. The method as claimed in claim 7, wherein the quality may be represented in color.

9. The method as claimed in claim 8, wherein the color representation takes place in such a way that different colors or shades of color show the different qualities.

10. The method as claimed in claim 1, wherein a drift of the countermeasure with respect to the vehicle can be shown in color.

11. The method as claimed in claim 1, wherein multiple positions of the threat are taken into account.

12. The method as claimed in claim 1, wherein the situation is updated after a defined time.

13. A system for protecting a vehicle against a threat, with at least one computer, at least one display, at least one launcher and at least one sensor, wherein the computer is designed in such a way that, for each change of course and speed, a resulting new overall situation is calculated including at least one new wind direction and wind speed and a threat direction and threat distance;

wherein a quality of the countermeasure is determined and displayed, wherein the quality gives information about the achievable separation of the countermeasure and the vehicle from the point of view of the threat.

14. The system as claimed in claim 13, wherein a display of the new overall situation in which a countermeasure for protecting the vehicle can still be successfully deployed.

15. The system as claimed in claim 13, wherein the computer is a fire control computer.

* * * * *